US005775353A

United States Patent [19]

Johnson

[11] Patent Number: 5,775,353

[45] Date of Patent: Jul. 7, 1998

[54] DYNAMICALLY-MOUNTED SHELTER FOR FLOATING BOAT DOCK

[76] Inventor: W. A. Johnson, 12406 Taylorsville Rd., Louisville, Ky. 40299

[21] Appl. No.: 880,029

[22] Filed: Jun. 20, 1997

[51] Int. Cl.[6] ..... E04H 15/02

[52] U.S. Cl. ..... 135/96; 135/97

[58] Field of Search ..... 135/96, 97, 98, 135/156, 157, 99, 151, 153, 154, 143, 147, 148

[56] References Cited

U.S. PATENT DOCUMENTS

| | | | |
|---|---|---|---|
| 1,836,060 | 12/1931 | Barnes | 135/96 X |
| 1,962,916 | 6/1934 | Smith | 135/99 |
| 2,640,999 | 6/1953 | Sheppard | 135/96 X |
| 2,912,703 | 11/1959 | Murphy | 135/157 X |
| 3,303,851 | 2/1967 | Grunfeld | 135/96 X |
| 3,354,892 | 11/1967 | Frieder . | |
| 3,417,764 | 12/1968 | Hemenway | 135/96 X |
| 4,346,725 | 8/1982 | Shaw | 135/96 X |
| 4,683,901 | 8/1987 | Mitchell . | |
| 5,573,026 | 11/1996 | Griffith | 135/97 X |

*Primary Examiner*—Lanna Mai
*Attorney, Agent, or Firm*—Middleton & Reutlinger; Daniel C. Stelter; James C. Eaves, Jr.

[57] ABSTRACT

A shelter for use in combination with a floating boat dock structure having a platform segment member, a first docking platform and a second docking platform provided with a canopy, a base support post depending downwardly therefrom, a first support post depending downwardly therefrom and a second support post depending downwardly therefrom. The base support post, the first support post and the second support post being pivotally attached to the canopy to provide pivotal motion of the respective support post relative to the canopy about any axis. The base support post being fixedly attached to the platform segment member of the floating boat dock structure. The first support post and the second support post being pivotally attached to the first docking platform and the second docking platform, respectively, to provide pivotal motion of the respective support posts relative to its respective docking platform about any axis. The shelter further includes a first response assembly and a second response assembly which cooperate to maintain a relative upright orientation of the shelter.

6 Claims, 9 Drawing Sheets

DYNAMICALLY-MOUNTED SHELTER FOR FLOATING BOAT DOCK

BACKGROUND OF THE INVENTION

1. Technical Field of the Invention

The present invention relates to shelters for boats tied to boat docks. More particularly, the present invention relates to shelters for boats tied to floating boat docks wherein a shelter is dynamically mounted to a floating boat dock.

2. Discussion of the Prior Art

It is often desirable to provide a shelter for a boat while the boat is tied in a body of water to a boat dock, such as, for example, when it is desirable to prevent overexposure of the boat to rain and/or sunlight.

Ordinarily, a typical boat dock is provided with a longitudinal platform spine member defined by a plurality of longitudinal platform segment members having first and second distal ends and being attached lengthwise to one another so that the respective first distal end of each successive platform segment member is hingedly attached to the respective second distal end of each preceding platform segment member. Floating devices are provided on an underside surface of each platform segment member, thereby permitting the platform spine member to float on the surface of a body of water.

A plurality of longitudinal first and second docking platforms typically extend outwardly from the platform segment member along respective axes which are perpendicular to an axis of the spine member. Further, the longitudinal first and second docking platforms are provided with floating devices on their respective underside surfaces to permit them to float on the surface of the body of water. The first and second docking platforms are respectively hingedly attached to the platform segment member along respective hinge lines which are parallel to the longitudinal axis of the platform segment member. The cooperation of the platform segment member and the docking platforms define a floating boat dock structure which is capable of responding to the natural movement and flow of the surrounding body of water.

Due to the fact that the floating boat dock structure is constructed from elements which are hingedly attached to one another, an upright shelter rigidly attached to such a floating boat dock structure is subject to dynamic and often destructive forces as the individual platforms move independently from one another under the influence of the surrounding water. Thus, it is often difficult to maintain an upright orientation of the shelter under the influence of such forces, as both the floating boat dock and the shelter respond to the typical movement of the surrounding water. Accordingly, it is desirable to provide a shelter for use on a floating boat dock, and more particularly, a shelter for use on a floating boat dock wherein the shelter is capable of minimizing its response to the movement of the floating boat dock under the influence of the movement of the surrounding water.

Previous attempts have heretofore been made to provide a shelter for a floating boat dock, such as, for example, U.S. Pat. No. 4,683,901 to Mitchell, which teaches a boat cover rigidly attached to a floating boat dock. However, it is desirable to provide a shelter which is moveable relative to the floating boat dock, and which thereby permits the shelter to respond to the movement of the floating boat dock under the influence of the movement of the surrounding water. It is furthermore desirable to provide a floating boat dock and a shelter which is mountable to the floating boat dock and wherein the floating boat dock is not permanently affixed to dry land.

SUMMARY OF THE INVENTION

It is an object of the present invention to provide a shelter for use in combination with a floating boat dock, wherein a boat is tied in a body of water to the floating boat dock.

It is another object of the present invention to provide a shelter for use in combination with a floating boat dock, wherein a boat is tied in a body of water to the floating boat dock, and wherein the shelter is dynamically mounted to the floating boat dock.

It is still another object of the present invention to provide a shelter for use in combination with a floating boat dock, wherein a boat is tied in a body of water to the floating boat dock, and wherein the shelter is adaptable to boats having varying sizes.

It is yet another object of the present invention to provide a shelter for use in combination with a floating boat dock, wherein a boat is anchored in a body of water to the floating boat dock, and wherein the floating boat dock is moveable in the water.

A shelter according to a preferred embodiment of the present invention and for use in combination with a floating boat dock structure having a platform segment member, a first docking platform and a second docking platform, includes a canopy, a base support post depending downwardly therefrom, a first support post depending downwardly therefrom and a second support post depending downwardly therefrom. The base support post, the first support post and the second support post each include first and second distal ends, the respective first distal end being pivotally attached to the canopy to provide pivotal motion of the respective support post relative to the canopy about any axis. The second distal end of the base support post is fixedly attached to the platform segment member of the floating boat dock structure. The second distal end of the first support post and the second support post are pivotally attached to the first docking platform and the second docking platform, respectively, to provide pivotal motion of the respective support posts relative to its respective docking platform about any axis.

The shelter further includes a first response assembly and a second response assembly which cooperate to maintain a relative upright orientation of the shelter.

BRIEF DESCRIPTION OF THE DRAWINGS

A better understanding of the present invention will be had upon reference to the following description in conjunction with the accompanying drawings in which like numerals refer to like parts, and wherein.

DETAILED DESCRIPTION OF THE PREFERRED EMBODIMENT

Figure 1:
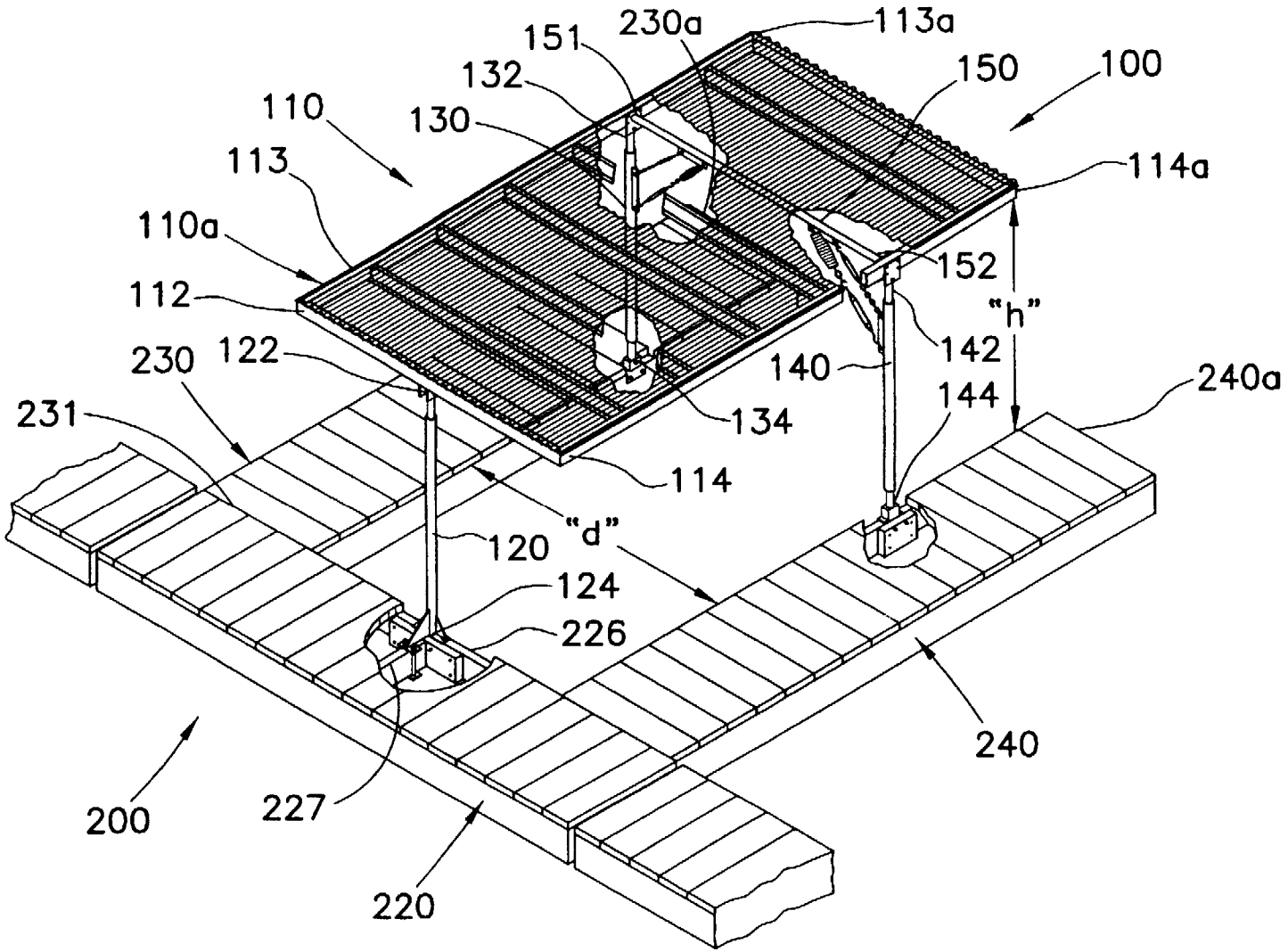
FIG. 1 is a top perspective view of a shelter according to a preferred embodiment of the present invention shown mounted to a floating boat dock, the canopy having portions cut away to better show some shelter components.

With reference to FIG. 1, a shelter 100 according to a preferred embodiment of the present invention is dynamically mounted to a floating boat dock 200. The floating boat dock 200 includes a spine platform 220 which may be comprised of one, or preferably, a plurality of platform segment members 221, a longitudinal first docking platform 230 hingedly attached to at least one platform segment member 221 along a first hinge line 231, and a longitudinal second docking platform 240 hingedly attached to at least one segment platform member 220 along a second hinge line 241.

Figure 1A:
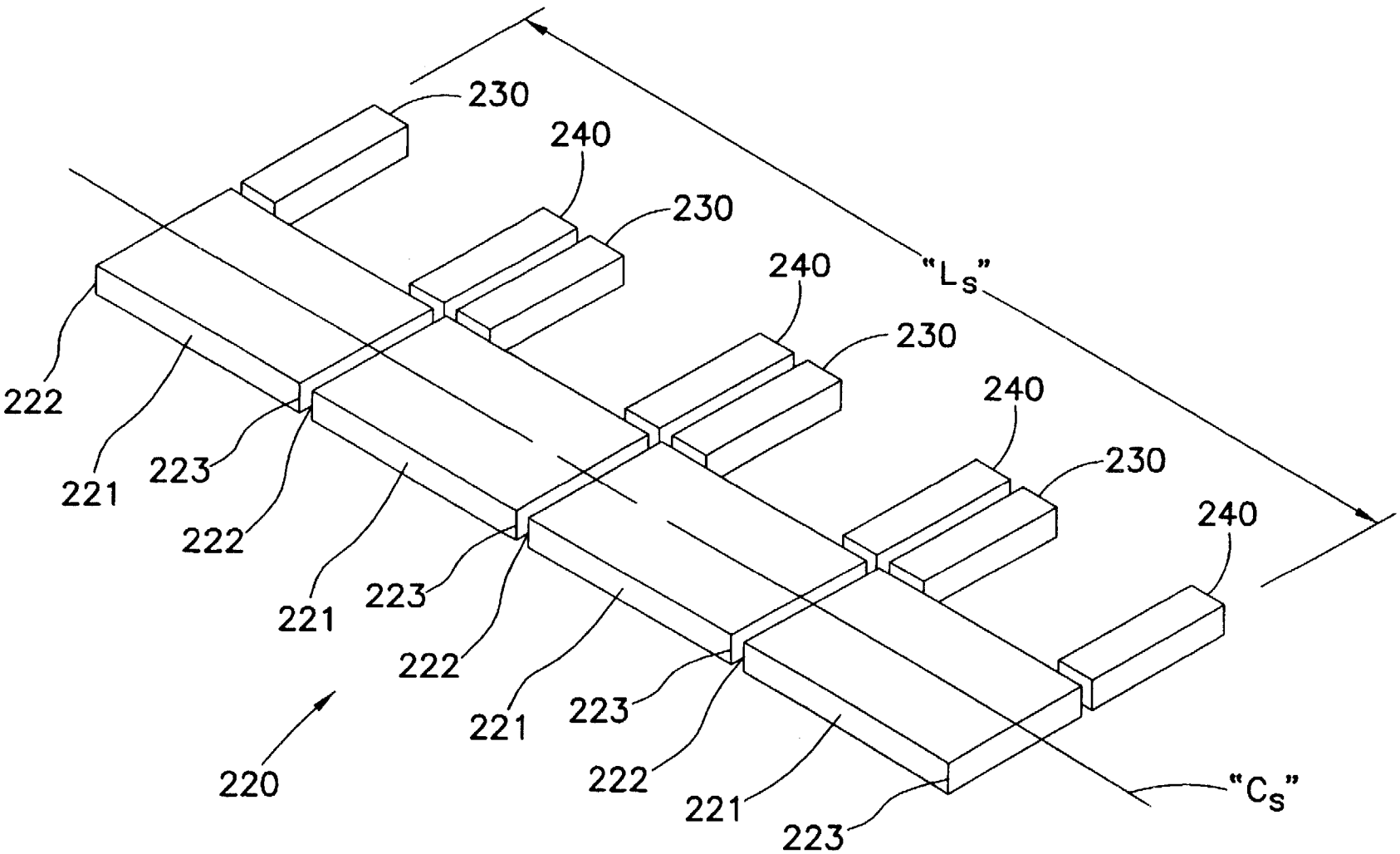
FIG. 1*a* is a top perspective view of a typical boat dock structure, showing a spine member being comprised of a plurality of platform segment members.

With reference to FIG. 1*a*, the spine platform 220 includes a length "$L_S$" and is defined by a plurality of platform segment members 221, each platform segment member 221 having respective first and second distal ends 222 and 223 thereof. FIG. 1*a* shows four platform segment members 221, although the present invention pertains to any number thereof. The platform segment members 221 are attached lengthwise along a longitudinal axis "$C_S$" of the spine member to one another so that the first distal end 222 of each successive platform segment member 221 is hingedly attached by means (not shown), such as, for example, a longitudinal hinge, to the second distal end 223 of the preceding platform segment member 221. Each platform segment member 221 may be provided with a separate first docking platform 230 and a second docking platform 240, or with multiple first and second docking platforms 230 and 240, if the platform segment member 221 is longer.

With reference back to FIG. 1, first hinge line 231 and second hinge line 241 are typically collinear, although alternative attaching means may be used to attach the first docking platform 230 and the second docking platform 240 to the platform segment member 221, so long as such alternative attaching means permits the platform segment member 221, the first docking platform 230 and the second docking platform 240 to move independently with respect to one another.

The first docking platform 230 and the second docking platform 240 extend along respective longitudinal axes perpendicular to a longitudinal axis of the platform segment member 221 and are parallel to one another. The first docking platform 230 is offset from the second docking platform 240 by a distance "d", which is sized to receive a boat (not shown). The platform segment member 221, the first docking platform 230 and the second docking platform 240 may be constructed from any suitable material, such as, for example, wood.

Floating devices (not shown), such as, for example, hollow, sealed barrels or hollow, air-filled bladders, are provided on an underside surface (not shown) of the platform segment member 221, on an underside surface of the first docking platform 230 and on an underside surface of the second docking platform 240. Thus, the platform segment member 221, the first docking platform 230 and the second docking platform 240 define a floating boat dock structure which floats on the surface of the water and responds to the movement of the surrounding water.

The shelter 100 includes a canopy 110 having a canopy frame **110*a* disposed in a plane offset from and substantially parallel to a plane containing the platform segment member 221, the first docking platform 230 and the second docking platform 240 by an adjustable distance "h", which is sized so that a boat (not shown) can be received between the first docking platform 230 and the second docking platform 240. The canopy frame 110*a* includes a base side member 112 disposed substantially parallel to the platform segment member 221, a first side member 113 disposed substantially parallel to the first docking platform 230, and a second side member 114 disposed substantially parallel to the second docking platform 240. The base side member 112, the first side member 113 and the second side member 114** are constructed from any substantially rigid material, such as, for example, tubular, channel or angle steel, and are properly treated to prevent corrosion.

A base support post 120 is pivotally attached at a first distal end 122 thereof to the canopy frame base side member 112 toward a midpoint thereof, and is fixedly attached at a second distal end 124 thereof opposite the first distal end 122 to the platform segment member 221 toward a midpoint between the first docking platform 230 and the second docking platform 240. A first support post 130 is pivotally attached at a first distal end 132 thereof to the canopy frame first side member 113 toward an end **113*a* thereof opposite the base side member 112, and is pivotally attached at a second distal end 134 thereof opposite the first distal end 132 to the first docking platform 230 toward an end 230*a* thereof opposite the platform segment member 221. A second support post 140 is pivotally attached at a first distal end 142 thereof to the canopy frame second side member 114 toward an end 114*a* thereof opposite the base side member 112, and is pivotally attached at a second distal end 144 thereof opposite the first distal end 142 to the second docking platform 240 toward an end 240*a* thereof opposite the platform segment member 221. The base support post 120, the first support post 130 and the second support post 140** are constructed from any substantially rigid material, such as, for example, tubular, channel or angle steel, and are properly treated to prevent corrosion.

The base support post 120 is pivotally attached to the canopy frame base side member 112 by means which permits simultaneous angular movement relative thereto about any axis. Preferably, a universal joint is used to provide such simultaneous angular movement. Similarly, the first support post 130 is pivotally attached to the first side member 113 and to the first docking platform 230 to permit simultaneous angular movement relative thereto about any axis. Likewise, the second support post 140 is pivotally attached to the second side member 114 and to the second docking platform 240 to permit simultaneous angular movement relative thereto about any axis. Universal joints are preferably used to permit such simultaneous movement.

A cross member 150 is fixedly attached at a first distal end 151 thereof to the canopy frame first side member 113 toward the first support post 130 and is fixedly attached at a second distal end 152 thereof opposite the first distal end 151 to the canopy frame second side member 140 toward the second support post 140. The cross member 150 is constructed from any substantially rigid material, such as, for example, tubular, channel or angle steel, and is properly treated to prevent corrosion.

Figure 2:
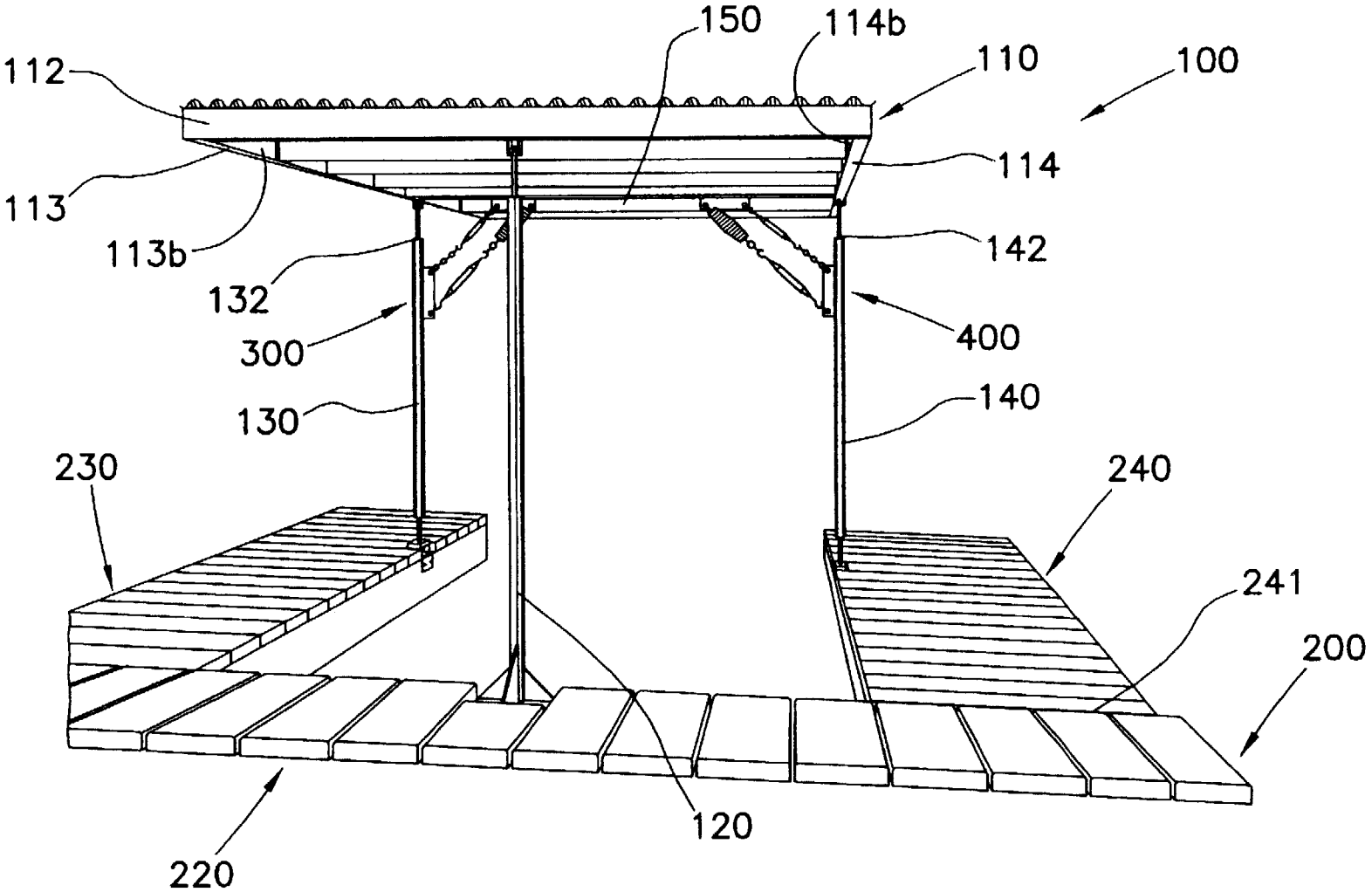
FIG. 2 is a front perspective view of the shelter of FIG. 1 shown mounted to a floating boat dock.
Figure 3:
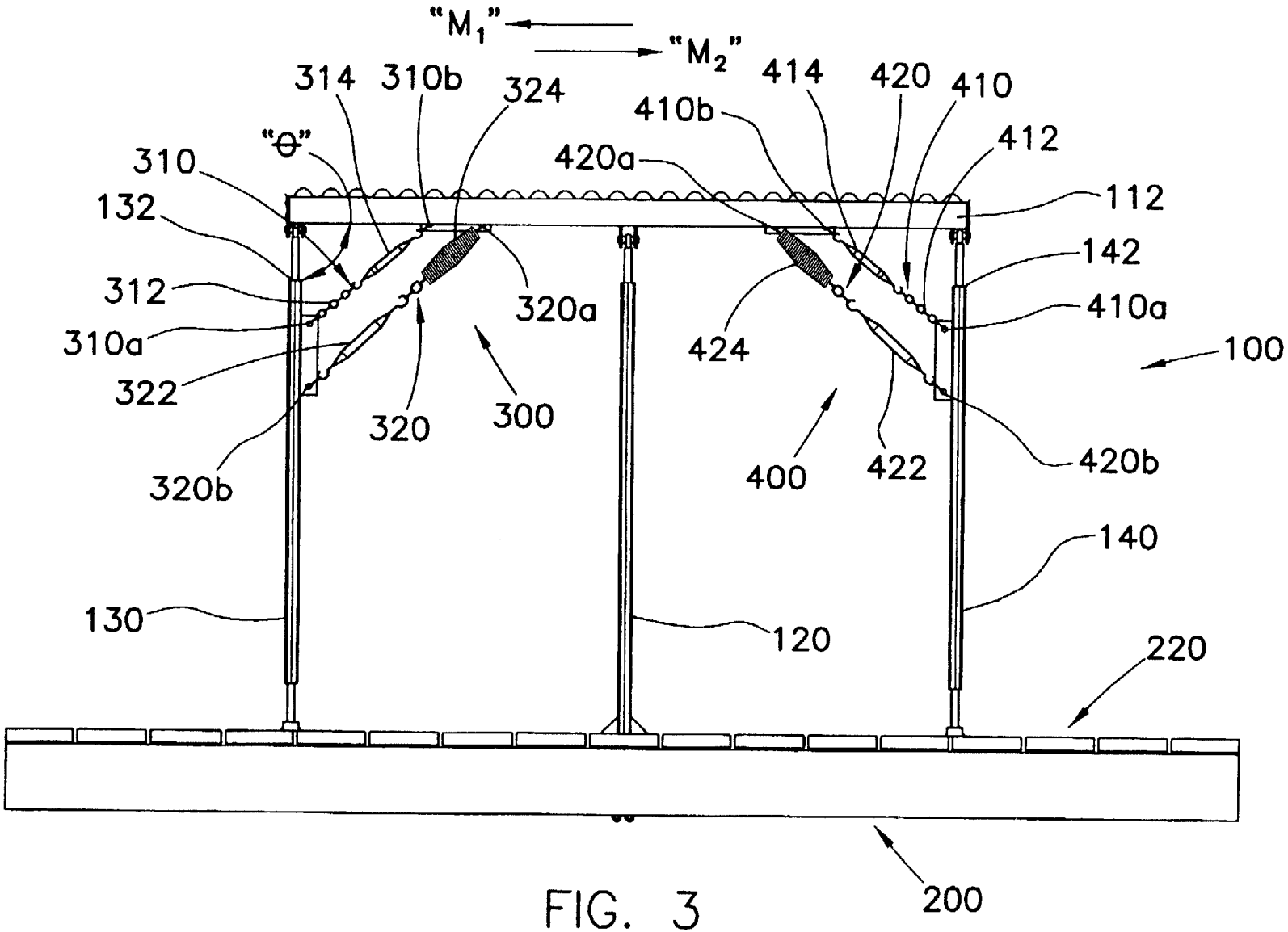
FIG. 3 is a front view of the shelter of FIG. 1 shown mounted to a floating boat dock.

With combined reference to FIGS. 2 and 3, a first response assembly 300 includes an adjustable static link member 310 having a static link portion 312 disposed at a first distal end **310*a* of the static link member 310** and a static link adjuster 314 attached in series to the static link portion 312 and disposed at a second distal end 310*b* of the static link member 310. The first distal end 310*a* of the static link member 310 is attached to the first support post 130 toward the first distal end 132 thereof; the second distal end 310*b* of the static link member 310 is attached to the cross member 150 at the first distal end 151 thereof. The first response assembly 300 further includes an adjustable dynamic link member 320 having a dynamic link adjuster 322 disposed at a first distal end 320*a* of the dynamic link member 320 and a dynamic link portion 324 attached in series to the dynamic link adjuster 322 and disposed at a second distal end 320*b* of the dynamic link member 320. The first distal end 320*a* of the dynamic link member 320 is attached to the first support post 130 toward the first distal end 132 thereof; the second distal end 320*b* of the dynamic link member 320 is attached to the cross member 150 toward the first distal end 151 thereof.

A second response assembly 400 includes an adjustable static link member 410 having a static link portion 412 disposed at a first distal end 410*a* of the static link member 410 and a static link adjuster 414 attached in series to the static link portion 412 and disposed at a second distal end 410*b* of the static link member 410. The first distal end 410*a* of the static link member 410 is attached to the second support post 140 toward the first distal end 142 thereof; the second distal end 410*b* of the static link member 410 is attached to the cross member 150 at the second distal end 152 thereof. The second response assembly 400 further includes an adjustable dynamic link member 420 having a dynamic link adjuster 422 disposed at a first distal end 420*a* of the dynamic link member 420 and a dynamic link portion 424 attached in series to the dynamic link adjuster 422 and disposed at a second distal end 420*b* of the dynamic link member 420. The first distal end 420*a* of the dynamic link member 420 is attached to the second support post 140 toward the first distal end 142 thereof the second distal end 420*b* of the dynamic link member 420 is attached to the cross member 150 toward the second distal end 152 thereof.

Figure 4:
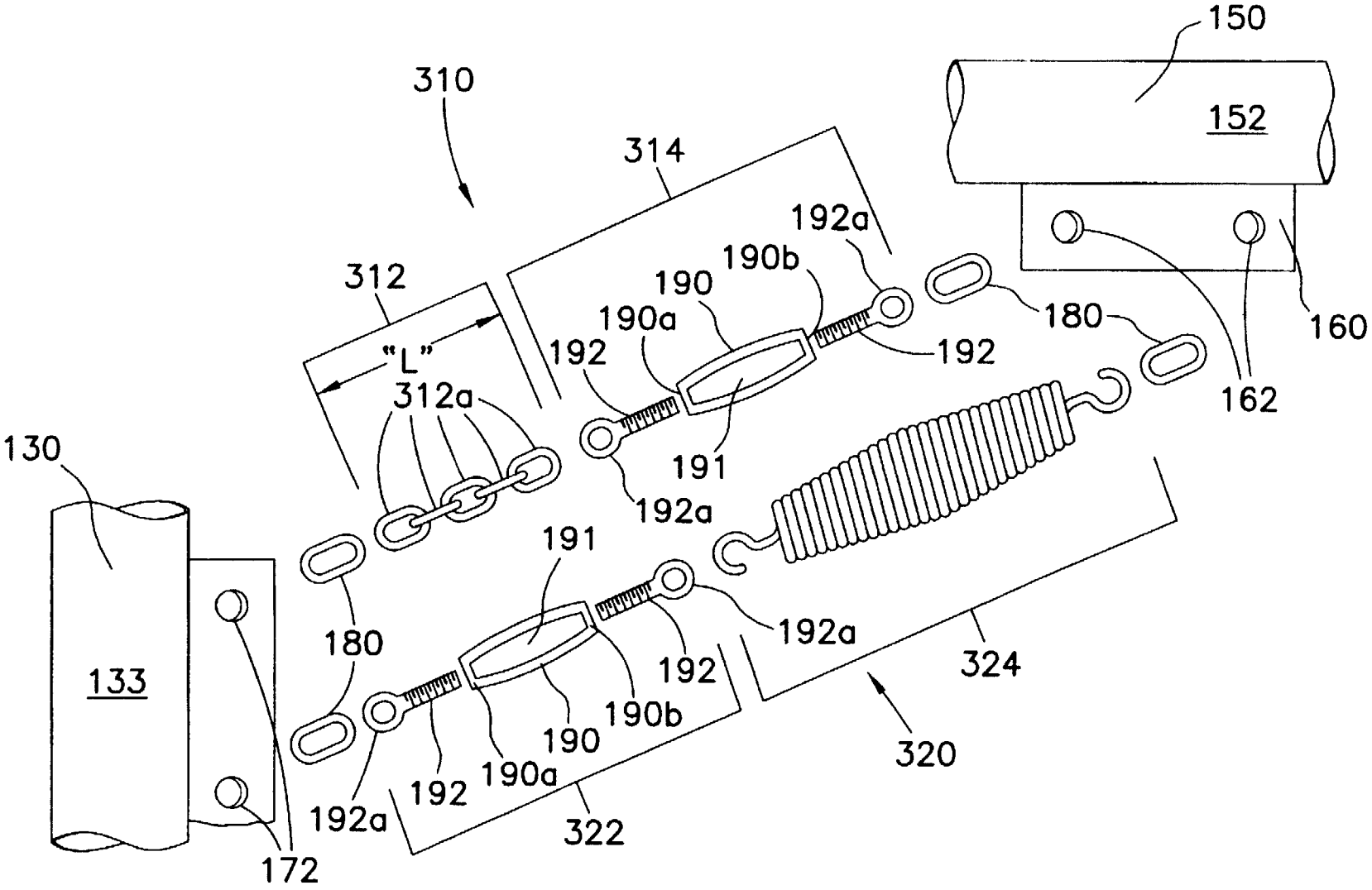
FIG. 4 is an exploded view of one element of the shelter of FIG. 1 showing the first response assembly.

With reference to FIG. 4, a horizontal mounting plate 160 is attached, such as, for example, by welding, to an outer surface 152 of the cross member 150 toward the first distal end 151 (FIG. 3) thereof, and a vertical mounting plate 170 is attached, such as, for example, by welding, to an outer surface 133 of the first support post 130 toward the first distal end 132 (FIG. 3) thereof. At least a pair of mounting bores 162 and 172 are provided through the mounting plates 160 and 170, respectively, to receive attachment links 180 provided to attach the respective distal ends of the static link member 310 and the dynamic link member 320 to the first support post 130 and to the cross member 150, respectively.

The static link adjuster 314 and the dynamic link adjuster 322 each include a longitudinal housing 190 having opposed distal ends 190*a* and 190*b*, respectively, a longitudinal slot 191 provided therethrough between the ends 190*a* and 190*b* and an internally-threaded bore (not shown) through each end 190*a* and 190*b* sized to respectively receive a threaded rod 192 having an outer end 192*a*. The threads of the opposed bores are in reverse orientation to one another so that rotation of the housing 190 in a first direction thereof simultaneously moves the threaded rods 192 inwardly within the longitudinal slot 191. Rotation of the housing 190 in a second direction thereof opposite the first direction simultaneously moves the threaded rods 192 outwardly therefrom. Thus, a distance between the outer ends 192*a* of the threaded rods 192 can be adjusted by rotating the housing 190.

The static link portion 312 is preferably constructed from a series of heavy-weight chain links 312*a* and defines a length "L" between distal ends of the static link portion 312. The dynamic link portion 324 is preferably constructed from a pre-fabricated heavy-weight coil spring. The dynamic link adjuster 322 is adjusted so that the dynamic link member 320 is substantially in tension when the shelter 100 is in a substantially upright orientation. The static link adjuster 314 is adjusted so that an overall length of the static link member 310 is greater than an overall length of the tensioned dynamic link member 320, so that when respective first and second distal ends of the static link member 310 and the dynamic link member 320 are moved apart from one another, such as, for example, when an interior and "Θ" (FIG. 3) between the first support post 130 and the cross member 150 is increased, tension in the dynamic link member 320, and more particularly, in the dynamic link portion 324, in increased before the static link member 310 experiences any tension. In the event that the dynamic link member 320 fails, the static link member 310, and more particularly, the static link portion 312, prevents the interior angle "Θ" from increasing to a point beyond which the shelter 100 would collapse.

The second response assembly static link member 410 is substantially similar to the first response assembly static link member 310, and the second response assembly dynamic link member 420 is substantially similar to the first response assembly dynamic link member 320. The first response assembly 300 and the second response assembly 400 cooperate to maintain a substantially upright orientation of the shelter 100. Referring particularly back to FIG. 3, when an external force is applied to the shelter 100 which causes movement of the canopy 110 substantially in the direction designated by reference numeral "$M_1$", such as, for example, when the surrounding water induces either upward movement of the second docking platform 240 or downward movement of the first docking platform 230, additional tensional forces are induced in the second response assembly dynamic link member 420, thereby causing the second response assembly dynamic link portion 424 to extend outwardly against the inherent inwardly-directed forces therein. Thus, the second response assembly dynamic link portion 424 resists further movement of the canopy 110 in the "$M_1$" direction and further induces movement thereof in an opposite direction designated by reference numeral "$M_2$", thereby returning the shelter 100 to a substantially upright orientation.

When an external force is applied to the shelter 100 which causes movement of the canopy 110 substantially in the direction designated by reference numeral "$M_2$", such as, for example, when the surrounding water induces either downward movement of the second docking platform 240 or upward movement of the first docking platform 230, or when response movement caused by the second response assembly 400 causes the shelter 100 to pass beyond a substantially upright orientation, additional tensional forces are induced in the first response assembly dynamic link member 320, thereby causing the first response assembly dynamic link portion 324 to extend outwardly against the inherent inwardly-directed forces therein. Thus, the first response assembly dynamic link portion 324 resists further movement of the shelter canopy 110 in the "$M_2$" direction and further induces movement thereof in the opposite "$M_1$" direction, thereby returning the shelter 100 to a substantially upright orientation.

Figure 5:
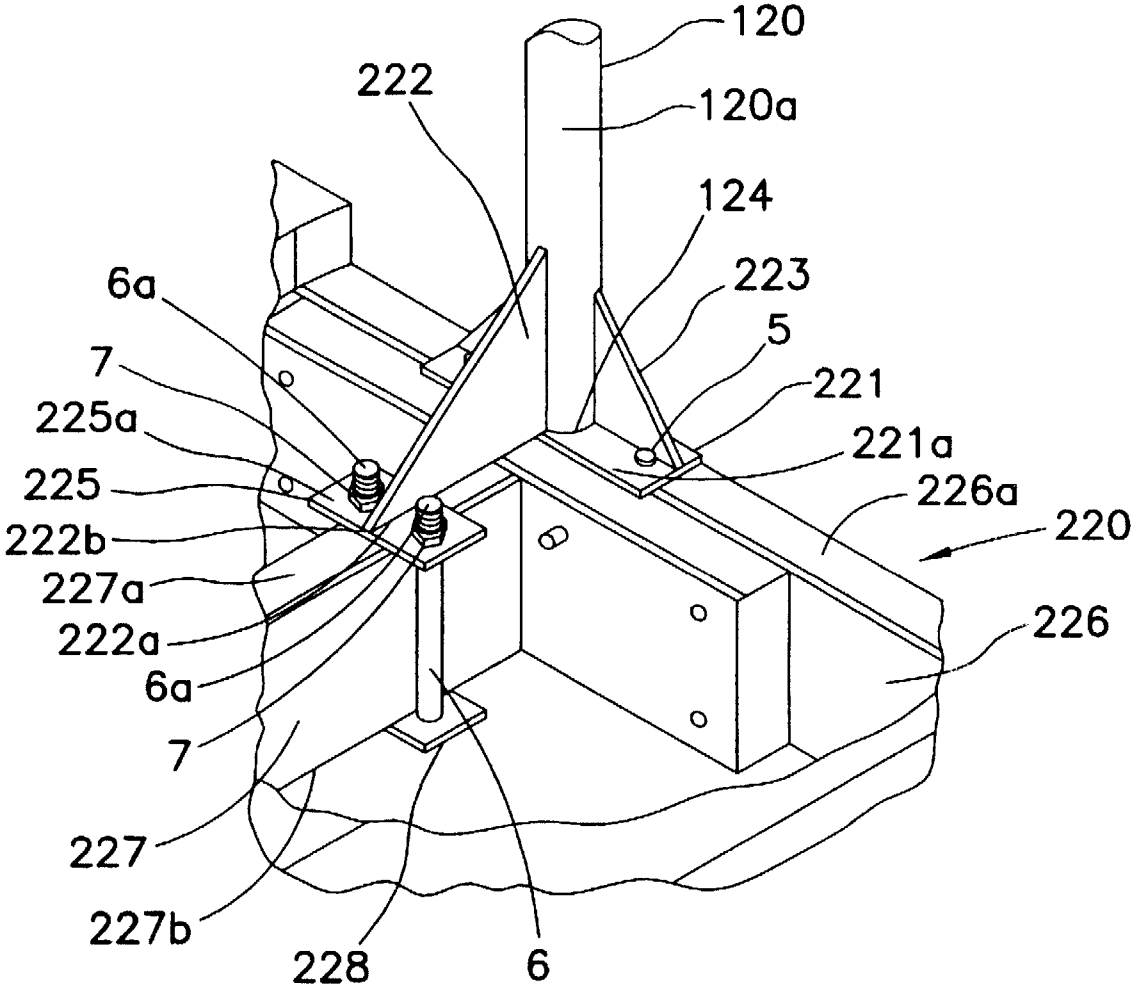
FIG. 5 is a top perspective view of a preferred means of attaching a base support post to a support platform.
Figure 5A:
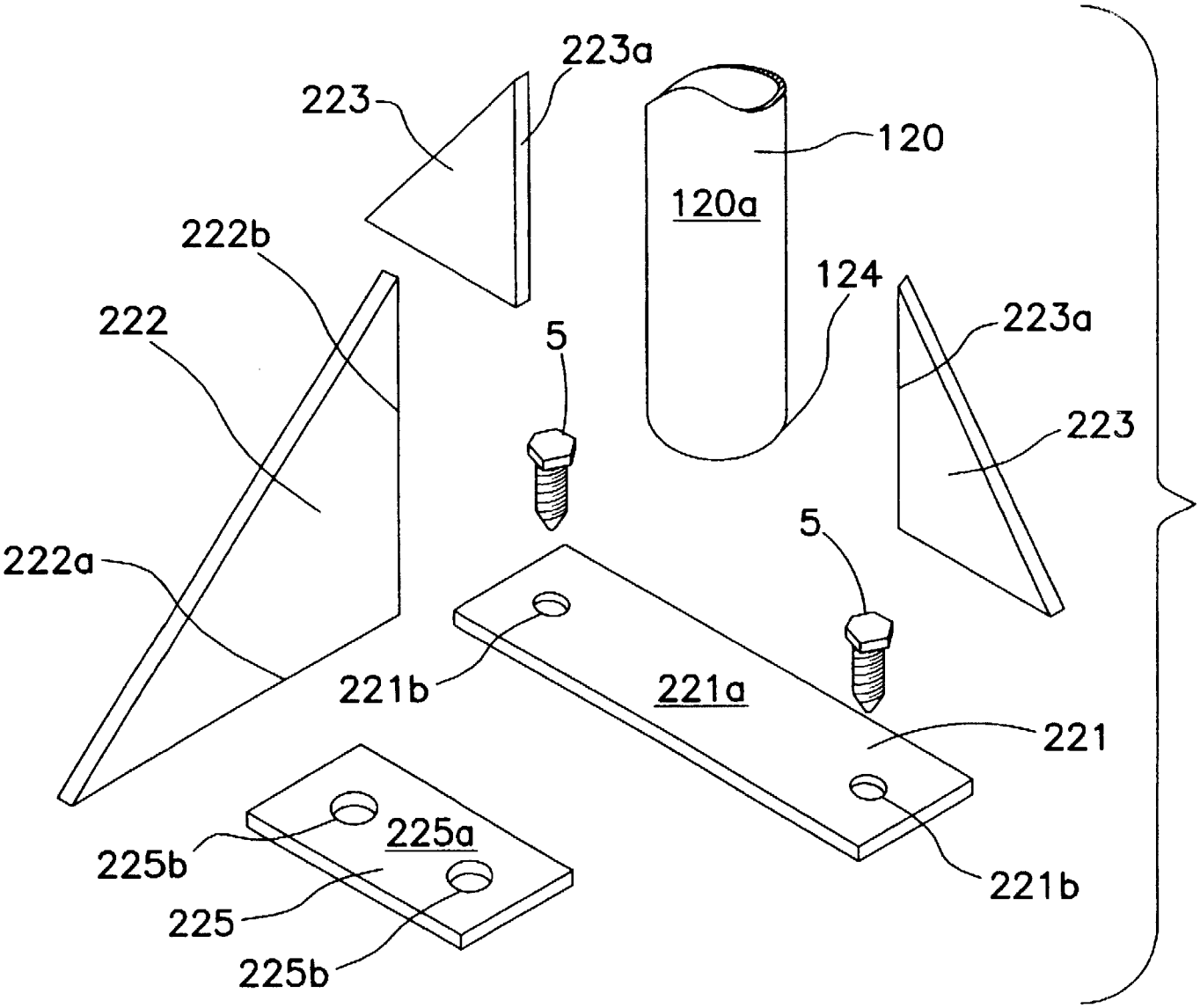
FIG. 5*a* is an exploded detail view of the attaching means of FIG. 5.

With combined reference to FIGS. 5 and 5*a*, a preferred means of fixedly attaching the second distal end 124 of the base support post 120 to the platform segment member 221 includes a mounting plate 221 fixedly attached on an upper surface 221*a* thereof to the second distal end 124 of the base support post 120, a first gusset 222 projecting outwardly and downwardly from an outer annular surface 120*a* of the base support post 120 and a pair of diametrically opposed side gussets 223 and 224 (not shown) projecting outwardly and downwardly from the outer surface 120*a* of the base support post 120 offset from the first gusset 222 by about 90°. The mounting plate 221, the first gusset 222 and the side gussets 223 and 224 are fixedly attached on respective inward ends 222*b* and 223*a* thereof to the base support post 120 by permanent attaching means, such as, for example, by welding. A first gusset plate 225 is fixedly attached on an upper surface 225*a* thereof by means such as, for example, by welding, to a lower end 222*a* of the first gusset 222 near an outermost end 222*b* thereof.

The mounting plate 221 is provided with bores 222*b* sized to receive a bolt 5. The first gusset plate 225 is provided with a pair of bores 225*b* near opposing distal ends thereof sized to receive a threaded rod 6.

The platform segment member 221 includes a longitudinal member 226 and a perpendicular cross member 227 projecting outwardly therefrom. The base support post 120 is positioned relative to the platform segment member 221 so that the mounting plate 221 substantially abuts an upper surface 226*a* of the longitudinal member 226 and the first gusset plate 225 substantially abuts an upper surface 227*a* of the cross member 227. Bolts 5 extend downwardly through the bores 221*b* provided on the mounting plate 221 and threadingly engage the longitudinal member 226.

A clamping plate 228 is disposed on a lower surface 227*b* of the cross member 227 and is provided with a pair of bores (not shown) near opposing distal ends thereof. A threaded rod 6 extends upwardly through the respective clamping plate bores and through the respective bores 225*b* of the first gusset plate 225. A threaded nut 7 is threadingly engaged with a terminal end 6*a* of the threaded rod 6 and tensioned, thereby clamping the cross member 227 between the first gusset plate 225 and the clamping plate 228.

Cooperation of all pivotal attaching means permits the shelter 100 to adjust to variations in relative angular orientations of the first docking platform 230 and the second docking platform 240 relative to the platform segment member 221 due to the movement of the surrounding water. Distance "h" can be adjusted to accommodate boats having varying sizes by sliding the rod 129 upwardly or downwardly in the support posts 120, 130 and 140, respectively. A locking means (not shown) may be included to lock the respective support posts 120, 130, and 140 at desired heights, thereby adjusting shelter height "h".

Figure 6:
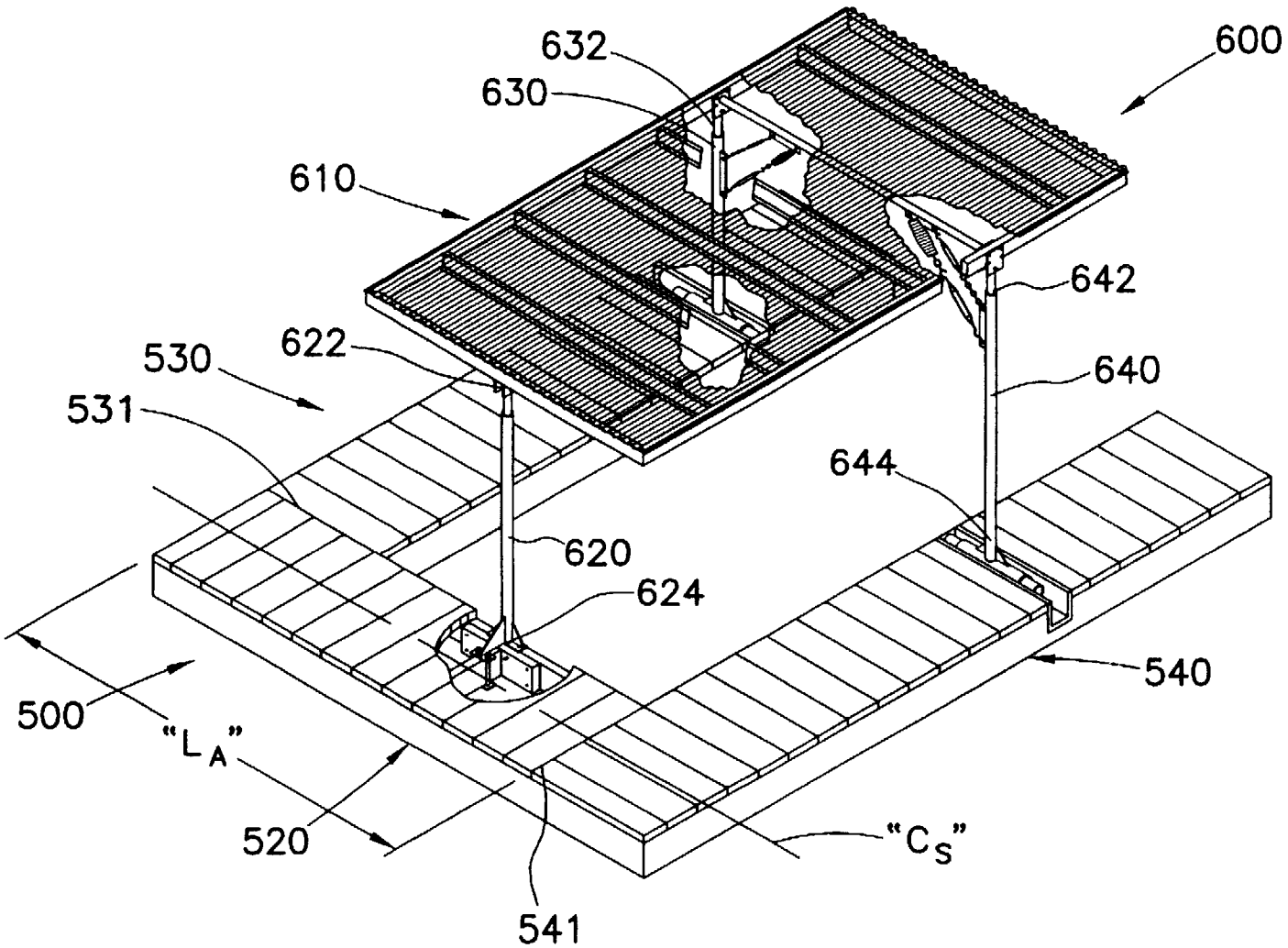
FIG. 6 is a top perspective view of a shelter according to another embodiment of the present invention shown mounted to a floating boat dock, the canopy having portions cut away to better show some shelter components; and, FIG. 7 is an exploded view of the alternative attaching means of FIG. 6.

With reference to FIG. 6, another embodiment of the present invention includes a shelter 600 attached to a free-floating boat dock 500 having a floating support platform 520 having a length "$L_A$", a first docking platform 530 and a second docking platform 540. Support platform 520 may be one platform segment member 221 (FIG. 1*a*) provided according to the preferred embodiment of the present invention. The support platform 520, the first docking platform 530, and the second docking platform 540 are constructed from any suitable material, such as, for example, wood, and are provided with floating devices (not shown), such as, for example, hollow, sealed barrels or hollow, air-filled bladders, on a respective underside surface (not shown) thereof. The cooperation of the floating support platform 520, the first docking platform 530 and the second docking platform 530 defines a floating boat dock structure 500 which is moveable in a body of water and which responds to the natural movement thereof.

The first docking platform 530 and the second docking platform 540 extend along respective axes perpendicular to a longitudinal axis "$C_S$" of the support platform 520 and are parallel to one another. The first docking platform 530 is pivotally mounted to the support platform 520 about a first hinge line 531; the second docking platform 540 is pivotally mounted to the support platform 520 about a second hinge line 541. The second hinge line 541 is preferably perpendicular to the first hinge line 531, thereby permitting the second docking platform 540 to pivot about an axis perpendicular to an axis about which the first docking platform 530 is permitted to pivot.

The shelter 600 includes a canopy 610 having a construction substantially similar to the construction of the canopy 110 (FIG. 1) of the preferred embodiment of the present invention and is dynamically mounted to the floating boat dock structure 500 by a downwardly-depending base support post 620, by a first support post 630 and by a second support post 640. Although the means by which the base support post 622, the first support post 632 and the second support post 642 are pivotally attached to the canopy 610 are substantially similar to the means by which corresponding elements are pivotally attached to their respective mating components in the preferred embodiment of the present invention, the present embodiment includes alternative means by which a second distal end 634 of the first support post 630 is pivotally attached to the first docking platform 530, and by which a second distal end 644 of the second support post 640 is pivotally attached to the second docking platform 540.

More particularly, the second distal end 634 of the first support post 630 is pivotally attached to the first docking platform 530 to permit angular movement about only an axis which is parallel to the first hinge line 531. Further, the present embodiment includes means by which the second distal end 644 of the second support post 640 is pivotally attached to the second docking platform 540 to permit angular movement about only an axis parallel to the first hinge line 531.

Figure 7:
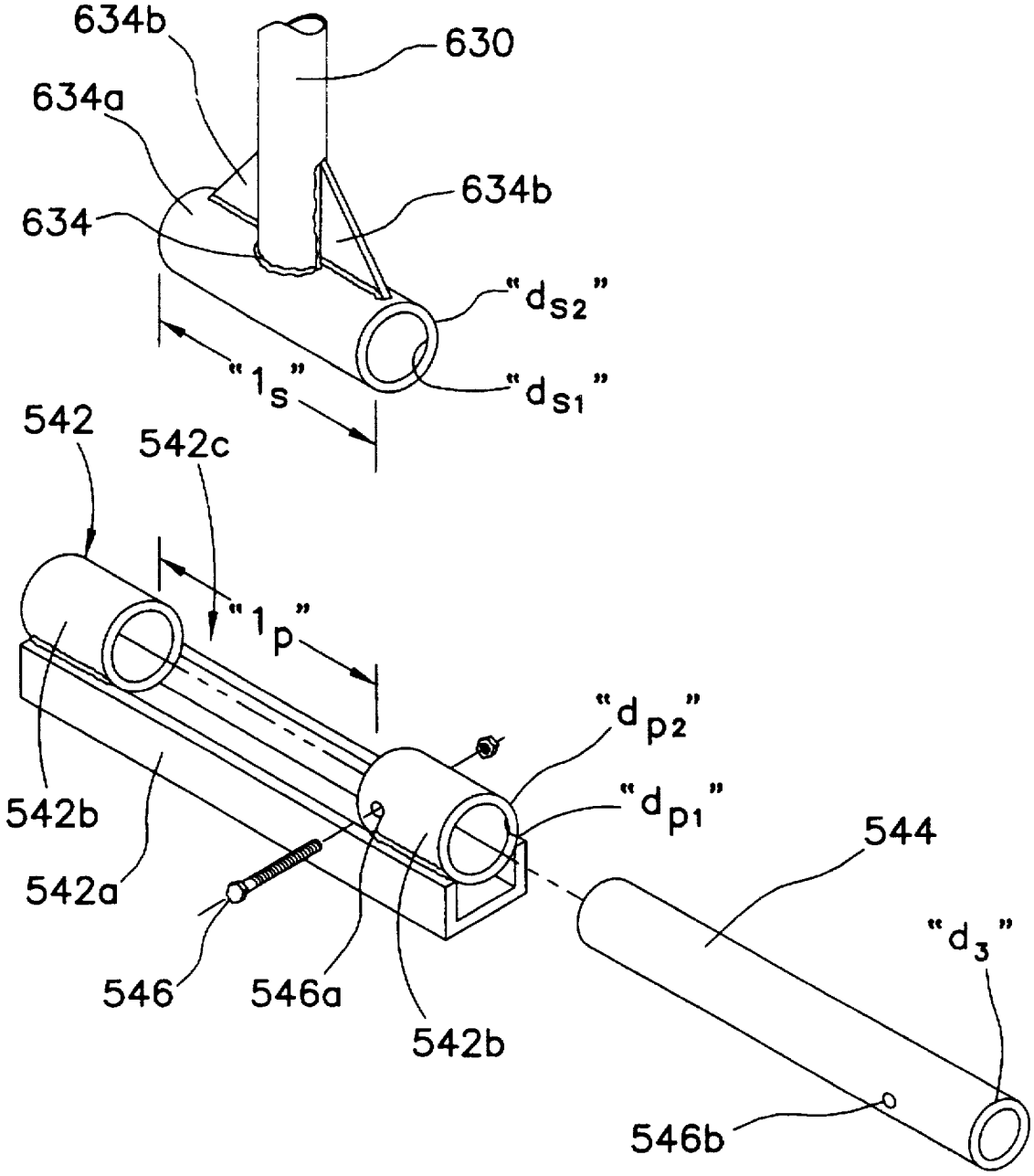

With reference to FIG. 7, means by which the first support post 630 and the second support post 640 are attached to and permitted to pivot about the first docking platform 530 and the second docking platform 540, respectively, along only an axis parallel to the first hinge line 531 includes a support post hinge portion 634*a*, a platform hinge portion 542 and a pin 544. The support post hinge portion 634*a* is fixedly attached, such as, for example, by welding, to the second distal end 634 of the first support post 630. Gussets 634*b* may be attached, such as, for example, by welding between the first support post 630 and the support post hinge portion 634*a*. Support post hinge portion 634*a* includes a length "$l_s$", an inner diameter "$d_{S1}$" and an outer diameter "$d_{S2}$".

The platform hinge portion 542 includes an upturned mounting frame 542*a* having a substantially upturned "U"-shaped cross section and a pair of pin-receiving portions 542*b* disposed toward distal ends of the mounting frame 542*a* and defining a support post receiving slot 542*c* having a length "$l_P$" sized to receive the support post hinge portion 634*a*, an inner diameter "$d_{P1}$" and an outer diameter "$d_{P2}$". The mounting frame 542*a* is attached, such as, for example, by bolting, to the first support platform 530.

The pin 544 includes an outer diameter "$d_3$" sized to be slidingly engageable within the inner diameter "$d_{S1}$" of the support post hinge portion 542 and within the inner diameter "$d_{P1}$" of the pin-receiving portions 542b.

The first support post 630 is pivotally attached to the first docking platform 530 by inserting the support post hinge portion 634a coaxially within the support post receiving slot 542c and by inserting the pin 544 through the respective inner diameters "$d_{P1}$," and "$d_{P1}$" of the support post hinge portion 634a and the pin-receiving portions 542b. A bolt 546 may be threaded through aligned bores 546a and 546b provided in the pin-receiving portion 542b and the pin 544, respectively.

In all other respects, the present embodiment is substantially similar to the preferred embodiment of the present invention.

The foregoing detailed description is given primarily for clearness and understanding and no unnecessary limitations are to be understood therefrom as modifications will become obvious to those skilled in the art upon reading this disclosure and may be made without departing from the spirit of the present invention.

I claim:

1. A shelter for use in combination with a boat dock having a support platform, a first docking platform extending therefrom, and a second docking platform extending therefrom, said shelter comprising:

a canopy having a base side member, a first side member extending perpendicularly from a first distal end of said base side member and a second side member extending perpendicularly from a second distal end of said base side member opposite said base side member first distal end, said second side member being parallel to said first side member;

a base support post depending downwardly from said base side member, said base support post having a first distal end pivotally attached to said base side member near a midpoint thereof, said base support post having a second distal end opposite said first distal end fixedly attached to said boat dock support platform;

a first support post depending downwardly from said first side member, said first support post having a first distal end pivotally attached to said first side member, said first support post having a second distal end opposite said first distal end pivotally attached to said boat dock first docking platform; and, a second support post depending downwardly from said second side member, said second support post having a first distal end pivotally attached to said second side member, said second support post having a second distal end opposite said first distal end pivotally attached to said boat dock second docking platform.

2. The combination of claim 1, said shelter further comprising:

a cross member fixedly attached at a first distal end thereof to said first side member near said first support post, said cross member being fixedly attached at a second distal end thereof opposite said first distal end to said second side member near said second support post;

a first response assembly attached at a first distal end thereof to said first support post near said first side member, said first response assembly being attached at a second distal end thereof opposite said first distal end to said cross member near said first side member; and, a second response assembly attached at a first distal end thereof to said second support post near said second side member, said second response assembly being attached at a second distal end thereof opposite said first distal end to said cross member near said second side member.

3. The combination of claim 2, wherein said first response assembly further comprises:

a first static link member;

a first dynamic link member;

a second static link member; and, a second dynamic link member.

4. The combination of claim 3, wherein:

said first response assembly first static link member includes a first static link portion having a fixed length and a first distal end thereof coincident with said first response assembly first distal end;

said first response assembly first static link member further includes a first static link adjuster attached at a first distal end thereof to a second distal end of said first static link portion opposite said first static link portion first distal end, said first static link adjuster having a second distal end thereof opposite said first static link adjuster first distal end, said first static link adjuster second distal end being coincident with said first response assembly second distal end;

said second response assembly second static link member includes a second static link portion having a fixed length and a first distal end thereof coincident with said second response assembly first distal end; and, said second response assembly second static link member includes a second static link adjuster attached at a first distal end thereof to a second distal end of said second static link portion opposite said second static link portion first distal end, said second static link adjuster having a second distal end thereof opposite said second static link adjuster first distal end, said second static link adjuster second distal end being coincident with said second response assembly second distal end.

5. The combination of claim 3, wherein:

said first response assembly first dynamic link member includes a first dynamic link portion having a variable length and a first distal end thereof coincident with said first response assembly first distal end;

said first response assembly first dynamic link member further includes a first dynamic link adjuster attached at a first distal end thereof to a second distal end of said first dynamic link portion opposite said first dynamic link portion first distal end, said first dynamic link adjuster having a second distal end thereof opposite said first dynamic link adjuster first distal end, said first dynamic link adjuster second distal end being coincident with said first response assembly second distal end;

said second response assembly second dynamic link member includes a second dynamic link portion having a variable length and a first distal end thereof coincident with said second response assembly first distal end; and, said second response assembly second dynamic link member further includes a second dynamic link adjuster attached at a first distal end thereof to a second distal end of said second dynamic link portion opposite said second dynamic link portion first distal end, said second dynamic link adjuster having a second distal end thereof opposite said second dynamic link adjuster first distal end, said second dynamic link adjuster second distal end being coincident with said second response assembly second distal end.

6. The combination of claim 1, wherein:

said boat dock is a floating boat dock and wherein said first docking platform is hingedly attached to said support platform along a first hinge line, and said second docking platform is hingedly attached to said support platform along a second hinge line, said second hinge line being perpendicular to said first hinge line.

* * * * *